US010900342B2

(12) United States Patent
Belaskie et al.

(10) Patent No.: US 10,900,342 B2
(45) Date of Patent: Jan. 26, 2021

(54) USING MODELS AND RELATIONSHIPS TO OBTAIN MORE EFFICIENT DRILLING USING AUTOMATIC DRILLING APPARATUS

(71) Applicant: Schlumberger Technology Corporation, Sugar Land, TX (US)

(72) Inventors: James Belaskie, Missouri City, TX (US); Richard John Meehan, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 205 days.

(21) Appl. No.: 15/775,054

(22) PCT Filed: Nov. 10, 2016

(86) PCT No.: PCT/US2016/061222

§ 371 (c)(1),
(2) Date: May 10, 2018

(87) PCT Pub. No.: WO2017/083454

PCT Pub. Date: May 18, 2017

(65) Prior Publication Data

US 2018/0328160 A1 Nov. 15, 2018

Related U.S. Application Data

(60) Provisional application No. 62/254,062, filed on Nov. 11, 2015.

(51) Int. Cl.
*E21B 44/04* (2006.01)
*E21B 19/00* (2006.01)
(Continued)

(52) U.S. Cl.
CPC ..... *E21B 44/04* (2013.01); *E21B 19/008* (2013.01); *E21B 21/08* (2013.01); *E21B 45/00* (2013.01); *E21B 47/06* (2013.01)

(58) Field of Classification Search
CPC ..... E21B 44/04; E21B 19/008; E21B 21/08; E21B 45/00; E21B 47/06
See application file for complete search history.

(56) References Cited

U.S. PATENT DOCUMENTS 2,688,871 A 9/1954 Arthur et al.
3,031,169 A 4/1962 Robinson et al.
(Continued)

FOREIGN PATENT DOCUMENTS

WO WO-2005113930 A1 * 12/2005 ..... E21B 44/04
WO WO2005113930 A1 12/2005
(Continued)

OTHER PUBLICATIONS

International Preliminary Report on Patentability for the equivalent International patent application PCT/US2016/061222 dated May 24, 2018.
(Continued)

*Primary Examiner* — Manuel L Barbee
(74) *Attorney, Agent, or Firm* — Alec J. McGinn

(57) ABSTRACT

A method for controlling an automatic drilling system includes measuring at least one drilling operating parameter applied to a drill string disposed in a wellbore when the drill string is suspended above the bottom of a wellbore. The drill string is lowered to drill the wellbore when the wellbore. At least one relationship is established between the at least one measured drilling operating parameter and corresponding values of a drilling response parameter at the surface and at the bottom of the drill string. A value of a rate of penetration parameter at surface is selected to operate the automatic drilling system so as to optimize a rate of penetration parameter at the bottom of the drill string.

22 Claims, 9 Drawing Sheets

(51) Int. Cl.

| | |
|---|---|
| ***E21B 21/08*** | (2006.01) |
| ***E21B 45/00*** | (2006.01) |
| ***E21B 47/06*** | (2012.01) |

(56) References Cited

U.S. PATENT DOCUMENTS

| | | | | |
|---|---|---|---|---|
| 4,491,186 | A | 1/1985 | Alder | |
| 4,662,608 | A | 5/1987 | Ball | |
| 4,825,962 | A | 5/1989 | Girault | |
| 4,875,530 | A | 10/1989 | Frink et al. | |
| 4,886,129 | A | 12/1989 | Bourdon | |
| 5,368,108 | A * | 11/1994 | Aldred | E21B 44/005 175/40 |
| 5,474,142 | A | 12/1995 | Bowden | |
| 5,713,422 | A | 2/1998 | Dhindsa | |
| 6,029,951 | A | 2/2000 | Guggari | |
| 2004/0256152 | A1 | 12/2004 | Dashevskiy et al. | |
| 2013/0228328 | A1 | 9/2013 | Chapman | |
| 2014/0027174 | A1 | 1/2014 | Ringer et al. | |

FOREIGN PATENT DOCUMENTS

| | | | | |
|---|---|---|---|---|
| WO | WO-2015073497 A1 * | 5/2015 | | E21B 44/00 |
| WO | WO2015073497 A1 | 5/2015 | | |

OTHER PUBLICATIONS

International Search Report and Written Opinion issued in International Patent application PCT/US2016/061222, dated Feb. 9, 2017. 17 pages.

Lidan Brake Servo Systems, Lidan Engineering AB, Jacobstorp, S-531 98, Lidkoping, Sweden, 2003, 12 pages.

Dow, et al., "Revolutionizing Drilling Performance through Advanced Real Time Performance Advisory System," SPE, Drilling Conference and Exhibition held in San Diego, California, USA, Mar. 6-8, 2012.

Dunlop, et al., "Increased Rate of Panetration Through Automation," SPE IADC Drilling Conference and Exhibition held in Amsterdam, The Netherlands, Mar. 1-3, 2011.

Extended Search Report for the equivalent European patent application 16864961.4 dated Mar. 25, 2019.

* cited by examiner

USING MODELS AND RELATIONSHIPS TO OBTAIN MORE EFFICIENT DRILLING USING AUTOMATIC DRILLING APPARATUS

CROSS REFERENCE TO RELATED APPLICATIONS

Priority is claimed from U.S. Provisional Application No. 62/254,062 filed on Nov. 11, 2015 and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of drilling wellbores through subsurface formations. More specifically, the disclosure relates to input controls used to operate an automatic drilling apparatus to increase drilling efficiency.

Obtaining a penetration depth as fast as possible during drilling may involve drilling at an optimum rate of penetration (ROP). One of the more difficult tasks performed by the driller is to maintain the weight on bit (WOB) as nearly as possible at the most efficient value. The WOB may be controlled by manually operating a friction brake to control the speed at which a drawworks winch drum releases a wire rope or cable. Manual control of WOB is difficult. The driller must visually observe a weight indicator or other display, such as a mud pressure gauge, and control the drum speed, for example by operating the brake, so as to maintain the WOB or mud pressure at or close to a selected value.

Some automatic drilling systems may use either control brake operation or control winch rotation, or both, using mechanical or electromechanical sensing devices and electrical and/or mechanical coupling of the sensing devices to the brake and/or winch controller. Some automatic drilling systems may also automatically control rotation of the rotary table or top drive. The foregoing devices and other electromechanical devices may be limited as to the particular drilling parameter that can be controlled, for example WOB, drilling fluid pressure, torque, winch drum rotation speed, drill string rotation speed or combinations of the foregoing.

DETAILED DESCRIPTION

Figure 1:
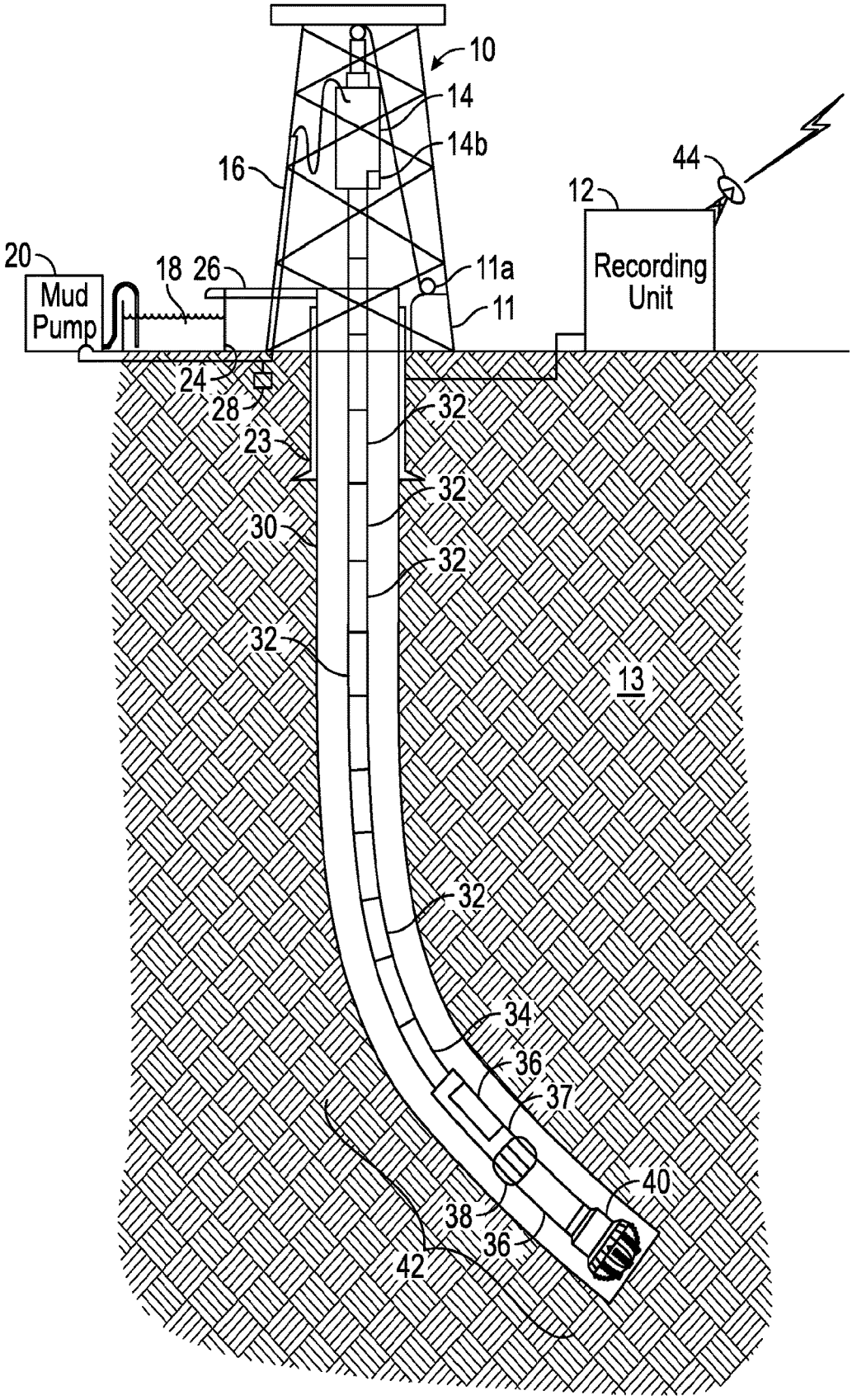
FIG. 1 shows an example embodiment of a well drilling unit including an example embodiment of an automatic drilling system.

FIG. 1 shows an example embodiment of a wellbore drilling system which may be used with various embodiments of methods according to the present disclosure. A drilling unit or "rig" 10 includes a drawworks 11 or similar lifting device known in the art to raise, suspend and lower a drill string. The drill string may include a number of threadedly coupled sections of drill pipe, shown generally at 32. A lowermost part of the drill string is known as a bottom hole assembly (BHA) 42, which includes, in the embodiment of FIG. 1, a drill bit 40 to cut through earth formations 13 below the surface. The BHA 42 may include various devices such as heavy weight drill pipe 34, and drill collars 36. The BHA 42 may also include one or more stabilizers 38 that include blades thereon adapted to keep the BHA 42 roughly in the center of the wellbore 22 during drilling. In various embodiments of a method according to the present disclosure, one or more of the drill collars 36 may include one or more measurement while drilling (MWD) sensors and a telemetry unit (collectively "MWD system"), shown generally at 37.

The drawworks 11 may be operated during active drilling so as to apply a selected axial force (weight on bit—"WOB") to the drill bit 40. Such WOB, as is known in the art, results from the weight of the drill string, a large portion of which is suspended by the drawworks 11. The unsuspended portion of the weight of the drill string is transferred to the bit 40 as WOB. The bit 40 may be rotated by turning the drill string using a rotary table/kelly bushing (not shown in FIG. 1) or a top drive 14 (or power swivel) of any type well known in the art. While the pipe 32 (and consequently the BHA 42 and bit 40 as well) is turned, a pump 20 lifts drilling fluid ("mud") 18 from a pit or tank 24 and moves the mud 18 through a standpipe/hose assembly 16 to the top drive 14 (or a swivel if a kelly/rotary table is used) so that the mud 18 is forced through the interior of the pipe 32 and then the BHA 42. Ultimately, the mud 18 is discharged into the wellbore 22 through nozzles or water courses (not shown) in the bit 40, whereupon the mud 18 lifts drill cuttings (not shown) to the surface through an annular space 30 between the wall of the wellbore 22 and the exterior of the pipe 32 and the BHA 42. The mud 18 then flows up through a surface casing 23 to a wellhead and/or return line 26. After removing drill cuttings using screening devices (not shown in FIG. 1), the mud 18 is returned to the tank 24. Other embodiments of a drill string may include an hydraulic motor (not shown) therein to turn the drill bit 40 in addition to or in substitution of the rotation provided by the top drive 14 (or kelly/rotary table).

The standpipe 16 in this embodiment may include a pressure transducer 28 which generates an electrical or other type of signal corresponding to the mud pressure in the standpipe 16. The pressure transducer 28 is operatively connected to systems (not shown separately in FIG. 1) inside a recording unit 12. The recording unit 12 may also include devices for decoding, recording and interpreting signals communicated from the MWD system 37. The MWD system 37 in some embodiments may include a device for modulating the pressure of the mud 18 to communicate data measured by various sensors in the MWD system 37 to the surface. In some embodiments the recording unit 12 may include a remote communication device 44 such as a satellite transceiver or radio transceiver, for communicating data received from the MWD system 37 (and other sensors at the earth's surface) to a remote location. The data detection and recording elements shown in FIG. 1, including the pressure transducer 28 and recording unit 12 are only examples of data receiving and recording systems which may be used with the methods according to the present disclosure, and accordingly, are not intended to limit the scope of the present disclosure. The top drive 14 may also include sensors (shown generally as 14B) for measuring rotational speed of the drill string (RPM), the amount of axial load suspended by the top drive 14 (WOB) and the torque applied to the drill string. The signals from these sensors 14B may be communicated to the recording unit 12 for processing as will be further explained. Another sensor which may be operatively coupled to the recording unit 12 is a drum rotary position encoder (not shown in FIG. 1). The encoder and its function will be explained below in more detail with respect to FIG. 2.

Figure 2:
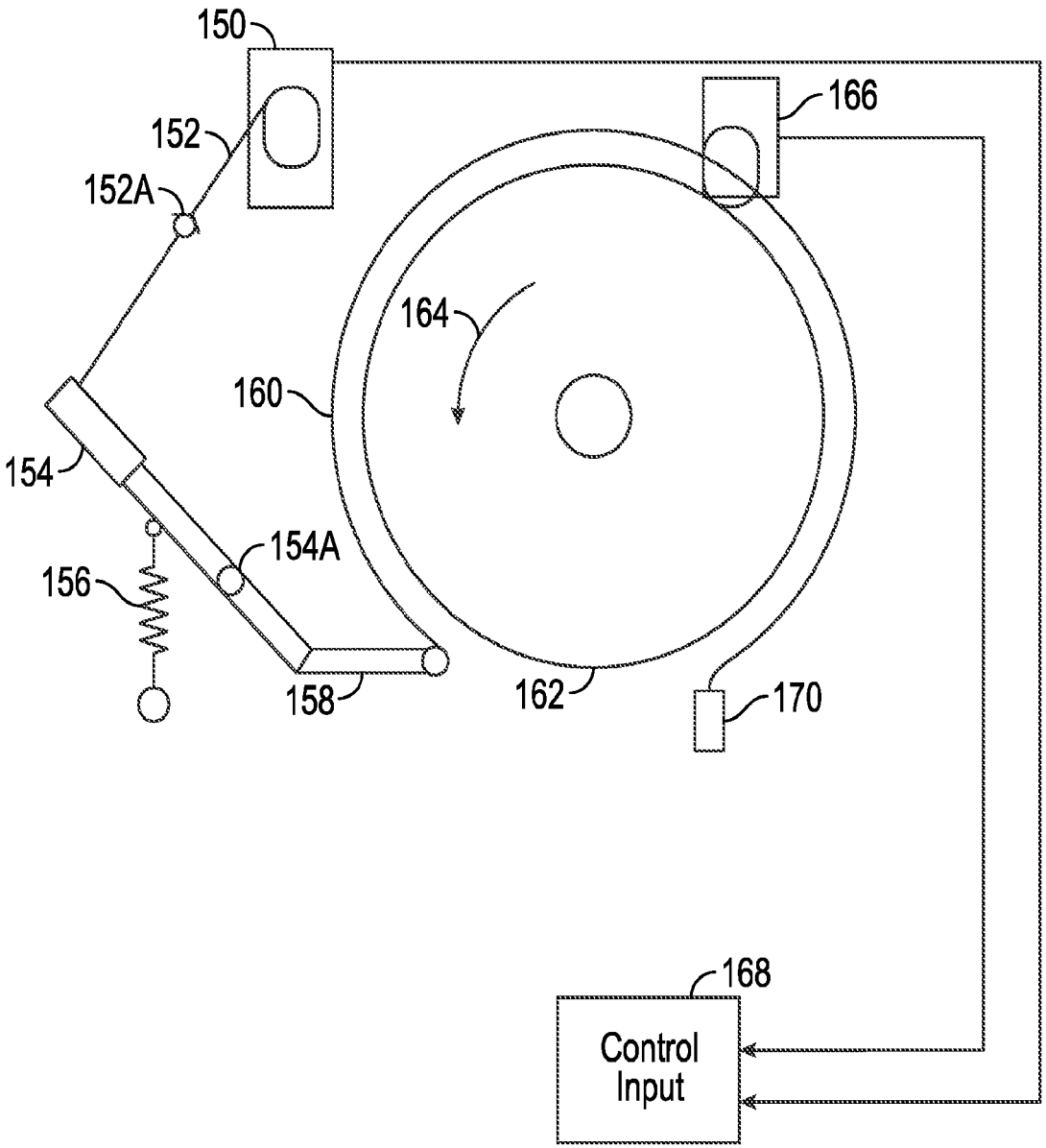
FIG. 2 shows an example embodiment of an automatic drilling system in more detail.

Referring now to FIG. 2, one embodiment of an automatic drilling system that uses the principle of brake control will now be explained. It is to be clearly understood that the illustrated embodiment of an automatic drilling system is only for purposes of explaining how to implement methods according to the present disclosure and is in no way intended to limit the type of automatic drilling system that may be used in any specific embodiment.

A band-type brake system may form part of the drawworks (11 in FIG. 1) and may include a brake band 160 usually formed from steel or similar material, and having a suitable friction lining (not shown) on its interior surface for selective engagement with a corresponding braking flange (not shown) on a winch drum 162. The winch drum 162 rotates in the direction shown by arrow 164 as the drill string (FIG. 1) is released into the wellbore (by extending a wire rope or cable "drill line" that is functionally engaged with a sheave and block system extending between the drilling unit superstructure or "derrick" and the swivel or top drive 14 in FIG. 1). The brake band 160 is anchored at one end by anchor pin 170, and is movable at its other end through a link 158 coupled to one end of a brake control handle 154. The brake control handle 154 is arranged on a pivot 154A or the like such that when the brake control handle 154 is lifted, the band 160 is released from engagement with the drum 162. Releasing the brake band 160 enables the drum to rotate as shown at 164, such that gravity can draw the drill string down, and through a drill line (not shown) ultimately wound around the drum, causes the axial motion of the drill string to be converted to drum 162 rotation. Applying the brake band 160 by releasing the handle 154 slows or stops rotation of the drum 162, and thus slows or stops axial movement of the drill string into the wellbore. Typically, the handle 154 will be drawn downward by a safety spring 156 so that in the event the driller loses control of the handle 154 the drum 162 will stop rotating. The spring 156 is a safety feature, but is not an essential part of a system used with methods according to the present disclosure.

In the present example embodiment, the automatic control system may include an electric servo motor 150 coupled to the brake handle 154 by a cable 152. The cable 152 may include a quick release 152A or the like of types well known in the art as a safety feature. A rotary position encoder 166 may be rotationally coupled to the drum 162. The encoder 166 generates a signal related to the rotational position of the drum 162. Both the servo motor 150 and the encoder 166 are operatively coupled to a controller 168, which may reside in the recording unit (12 in FIG. 1) or elsewhere on the drilling rig (10 in FIG. 1). The controller 168 may be a purpose-built digital processor, or may be part of a general purpose, programmable computer.

The servo motor 150 may include an internal sensor (not shown separately in FIG. 2), which may be a rotary encoder similar to the encoder 166, or other position sensing device, which communicates the rotational position of the servo motor 150 to the controller 168. The encoder 166 in the present embodiment may be a sine/cosine output device coupled to an interpolator (not shown separately) in the controller 168. The encoder 166 in the present embodiment, in cooperation with the interpolator, generates the equivalent of approximately four million output pulses for each complete rotation of the drum 162, thus providing extremely precise indication of the rotational position of the drum 162 at any instant in time. A suitable encoder is sold under model designation ENDAT MULTITURN EQN-425, made by Dr. Johannes Heidenhain GmbH, Traunreut, Germany. It is within the scope of the present disclosure for other encoder resolution values to be used.

The controller 168 determines, at a selected calculation rate, the rotational speed of the drum 162 by measuring the rate at which pulses from the encoder 166 are detected. In the present embodiment, the controller 168 may be programmed to operate a proportional integral derivative (PID) control loop, such that the servo motor 150 is operated to move the brake handle 154 if the calculated drum 162 rotation speed is different than a value determined by a control input. The control input will be further explained below with respect to FIGS. 3 and 4. The embodiment shown in FIG. 2 is only one example of coupling a servo motor to a band-type brake. Those of ordinary skill in the art will appreciate that other devices may be used to couple the rotary motion of the servo motor 150 to operate the brake band 160. Advantageously, a system made as shown in FIG. 2 can be easily and inexpensively adapted to many existing drilling rigs.

Figure 3:
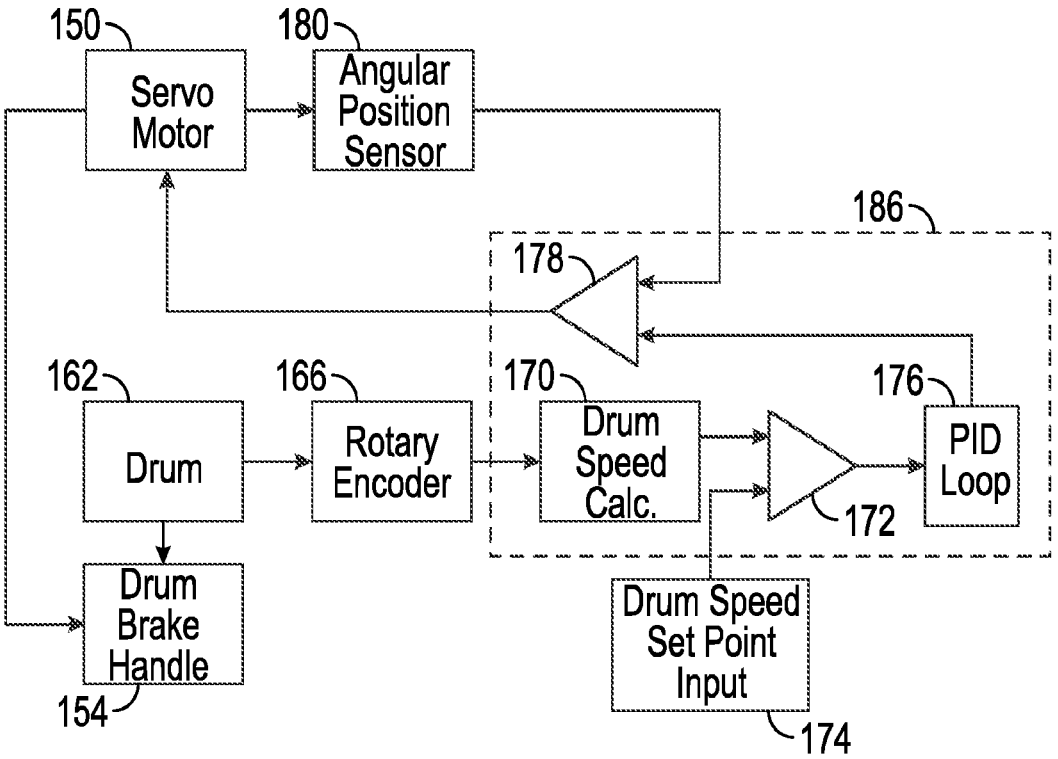
FIG. 3 shows a block diagram of an example embodiment control for an automatic drilling system usable with a brake control as in FIG. 2.

The control input signal shown in FIG. 2 and its relationship to controlling brake handle operation may be better understood by a logic flow diagram shown in FIG. 3. A subprocess may operate on the controller 168 (or other computer) to make a determination of the drum rotation speed from the signal conducted from the encoder 166. The drum speed forms one input to a comparator 172. The previously described drum speed set point control signal 174 forms the other input to comparator 172. The output of comparator 172 is conducted to the PID loop 176, which may run on the controller 168, or a separate processor or computer. The output of the PID loop 176 is an expected rotational position of the servo motor 150. Because the servo motor 150 is directly coupled to the brake handle (154 in FIG. 2), the servo motor 150 rotational position substantially directly corresponds to the position of the brake handle 154. The expected position is compared, in a comparator 178, to the actual position of the servo motor 150 determined from the position sensor 180 in the servo motor 150. The output of comparator 178 may be used to drive the servo motor 150 until the difference is substantially zero. The control loop described above with respect to FIG. 3 enables the brake controller to maintain a drum rotation rate at whatever value is determined with respect to the drum speed set point control signal input to the controller 168. As will be explained below with respect to FIG. 5, the control signal may be a fixed value corresponding to a selected rate of penetration, or the control signal may be automatically determined by calculation performed on one or more sensor measurements.

Figure 4:
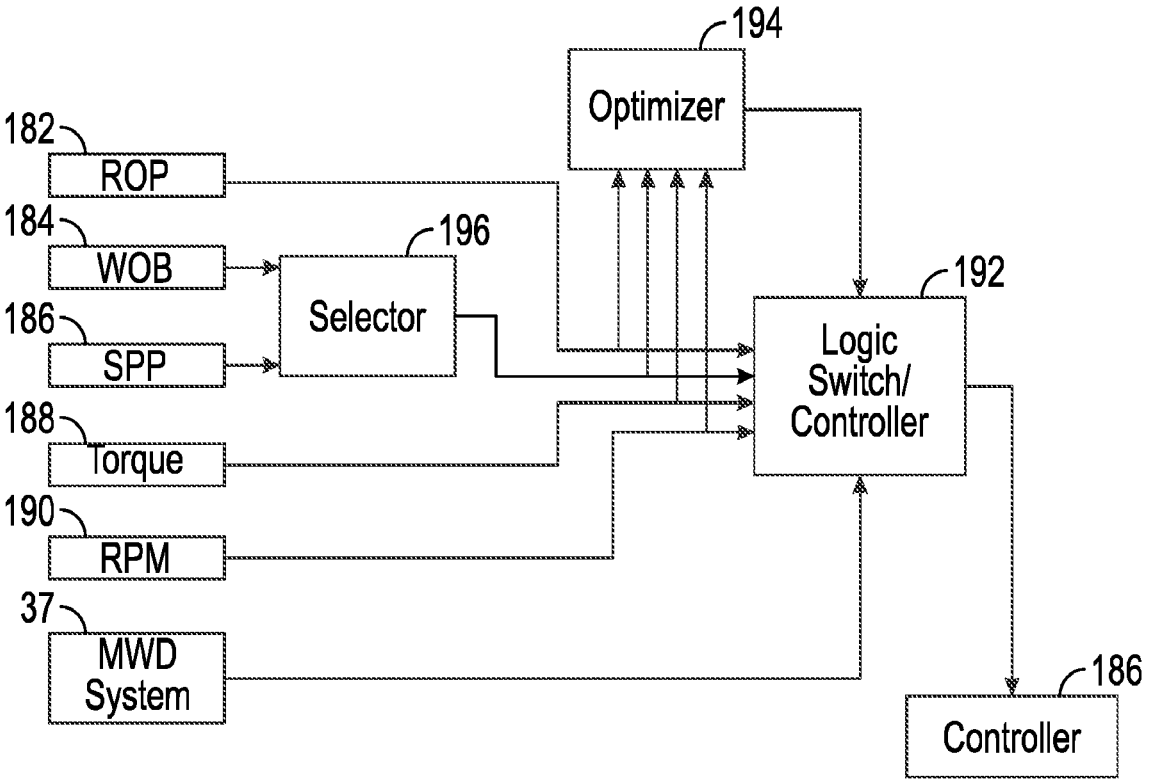
FIG. 4 shows a block diagram of an example embodiment of a rate of release control for an automatic drilling system as in FIG. 3.

FIG. 4 shows different signal inputs which may be used in various embodiments. Inputs which may originate from sensors disposed at the earth's surface include ROP 182 itself (determined from drum rotation rate as explained above with respect to in FIG. 3); WOB from a sensor on the drill line or hook (e.g., 14B in FIG. 1); drilling fluid standpipe pressure (SPP) 186 (from transducer 28 in FIG. 1); torque (from sensor 14B in FIG. 1); and RPM (from sensor 14B in FIG. 1). Measurements which may originate from the MWD system (37 in FIG. 1) may include wellbore azimuth, wellbore inclination, formation resistivity, drilling fluid pressure in the wellbore annulus (30 in FIG. 1) and amounts of axial, lateral and/or rotational acceleration measured by the various sensors in the MWD system (37 in FIG. 1) and communicated through modulation of the mud pressure, as previously explained. A logic switch/controller 192, which may operate on the controller (168 in FIG. 3) or any other computer or hardware implementation, may select any one or more of the sensor signals as an input to determine a set point for rotation rate of the drum (and consequent rate of release of the drill string).

In the present example embodiment, measurements of ROP, WOB, standpipe pressure, RPM and/or torque may be conducted to an optimizer 194. The optimizer 194 may operate a rate of penetration optimizing algorithm as will be further explained below. An optimized value of ROP determined by the optimizer algorithm may be conducted to the logic switch/controller 176, then to the controller 168 for controlling drum rotation rate to match the actual rate of release of the pipe (32 in FIG. 1) to the optimized value of ROP.

Programming of the optimizer 194 will now be explained with reference to FIGS. 5 through 16. The optimizer 194 may be programmed using a drilling model that is data driven and is updated in real-time for the state condition of the surface and downhole equipment and for the formation being drilled. This section of the disclosure will focus on how the drilling relationships are generated and maintained in real time.

The first action for the system is performing automated off-bottom calibrations by taking measurements of hookload (e.g., suspended weight measured by sensor 14B in FIG. 1), standpipe pressure, mud flow rate and torque while pumping (i.e., operating the pump 20 in FIG. 1) and rotating with the block (e.g., top drive 14 in FIG. 1) position stationary. After filtering to ensure the measurements are at a steady state, the values of total hookload, off bottom mud pressure, flow rate and rotating torque are measured and recorded. As drilling progresses, off bottom calibrations may be performed at selected times, including at every connection (i.e., when a section of pipe 32 in FIG. 1 is added to the drill string). The foregoing procedure is shown at 200 in FIG. 5.

While drilling, the off bottom calibration values are used to estimate conditions at the bit (40 in FIG. 1). The hookload while drilling and the total hookload from the off bottom calibration (200 in FIG. 5) may be used to compute the weight on the bit as shown in FIG. 6 at 202.

Figure 5:
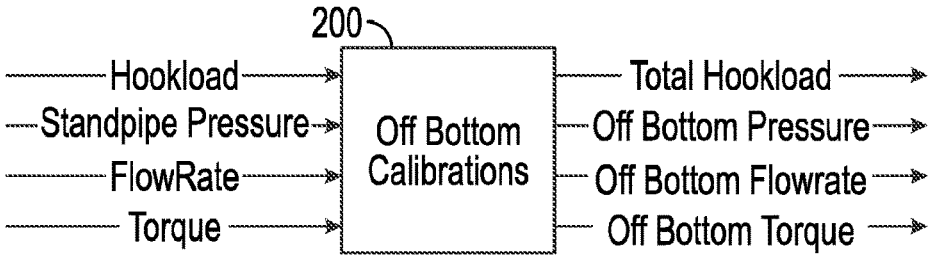
FIGS. 5 through 16 shows diagrams of how to determine certain relationships between measured drilling parameters and selected rate of release of a drill string (ROP).
Figure 6:
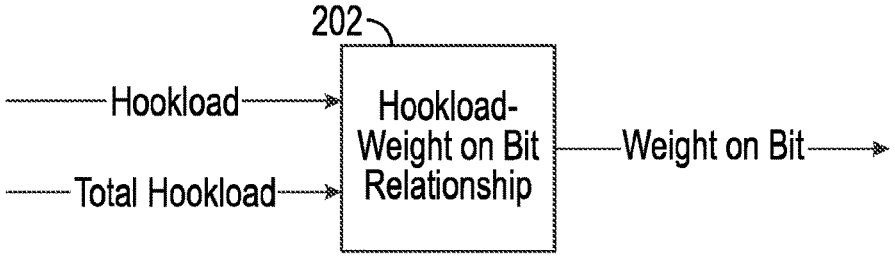
Figure 7:
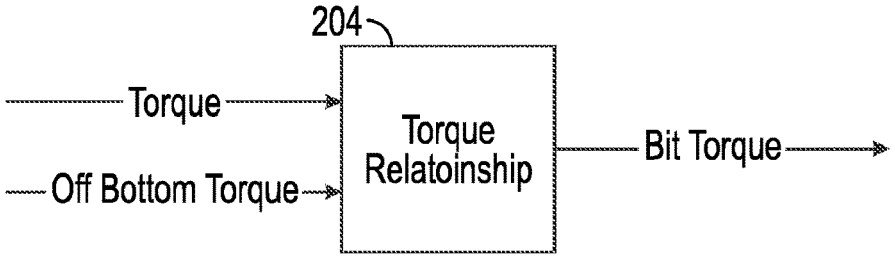

The torque while drilling and the off bottom torque from the calibration of FIG. 5 may be used to compute the bit torque as shown in FIG. 7 at 204.

Figure 8:
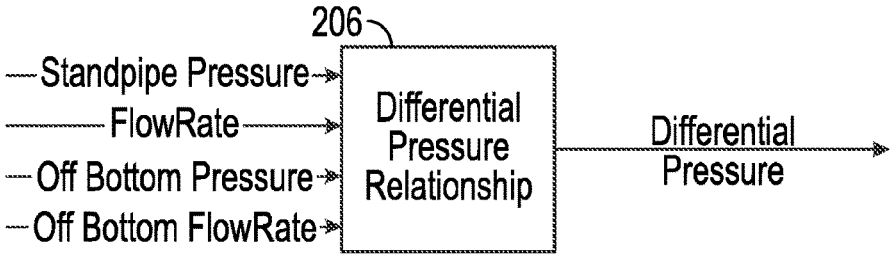

The stand pipe pressure and mud flow rate while drilling and the off bottom pressure and flow rate from the calibration of FIG. 5 may be used to compute the differential pressure as shown in FIG. 8 at 206.

Figure 9:
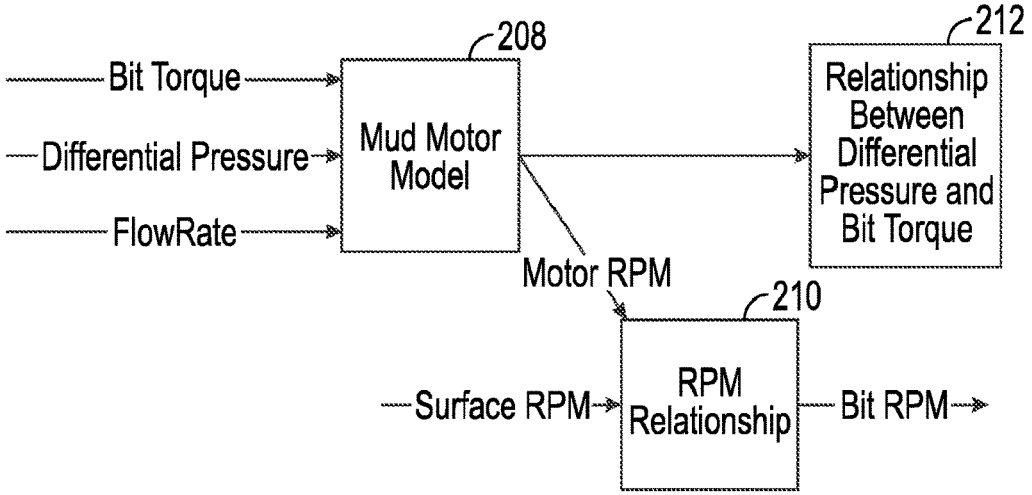

If a mud motor is used, the parameter model receives the bit torque, differential pressure and flow rate as inputs, as shown at 208 in FIG. 9. The mud motor parameter model may compute the motor rotation speed (RPM) and may determine a relationship between the differential pressure (i.e., increase in pressure from the off-bottom calibration shown in FIG. 5) and the motor torque as shown at 212 in FIG. 9. The motor RPM and surface RPM may be input into an RPM relationship to compute the current bit RPM while drilling as shown at 210 in FIG. 9.

Figure 10:
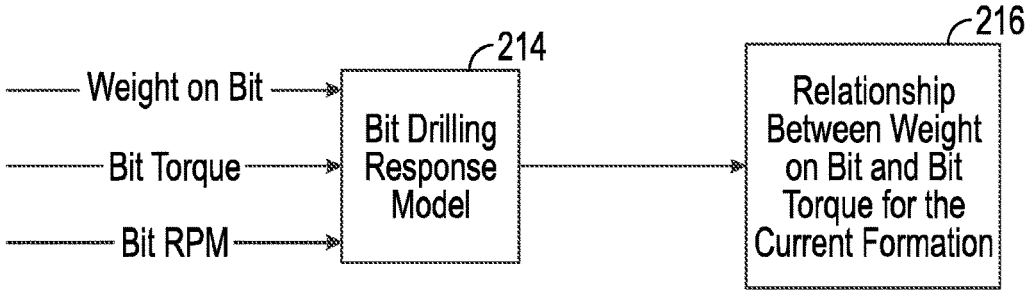

The real time weight on bit, bit torque and bit rpm are input into a bit drilling response model at 214 in FIG. 10 to determine a relationship between weight on bit and bit torque for the current formation being drilled as shown at 216 in FIG. 10.

Figure 11:
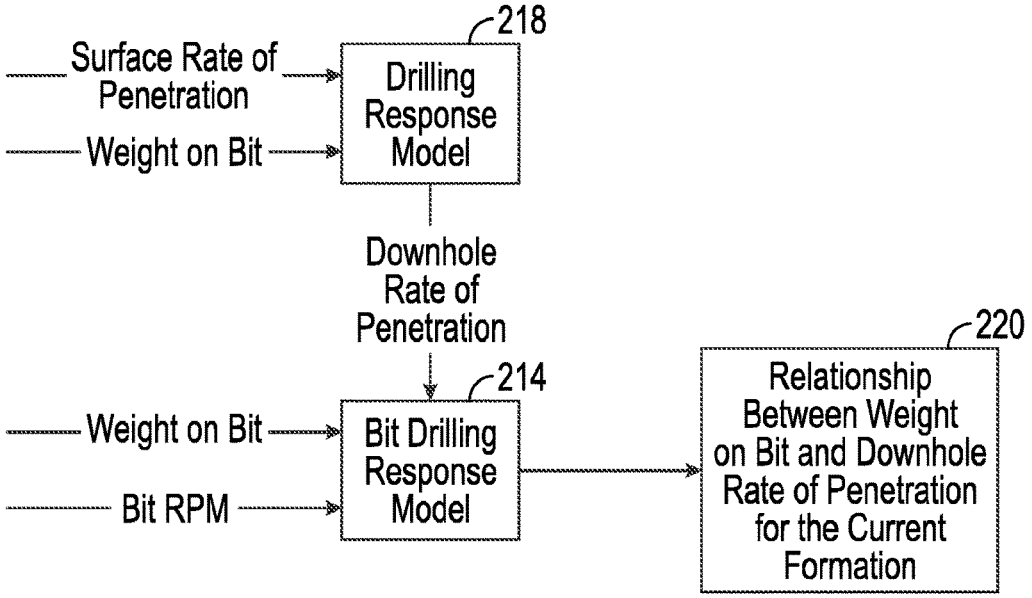

The surface rate of penetration and the weight on bit may be input into a drill string response model at 218 in FIG. 11, which computes an estimate of the downhole rate of penetration. The downhole rate of penetration, weight on bit and bit RPM may be input into the bit drilling response model at 214 to determine a relationship between the weight on bit and the downhole rate of penetration for the current formation being drilled as shown at 220 in FIG. 11.

The foregoing models may be used in the optimizer (194 in FIG. 4) in real-time to compute the weight on bit and rotary speed of the bit (RPM) needed to optimize the rate of penetration (ROP) while maintaining the equipment inside limits for torque, WOB, RPM, rate of penetration and differential pressure.

The relationships generated as explained above reflect the current state of drilling. The relationships take into account parameters such as the actual configuration of the drill string (pipe 32 and BHA 42) in the wellbore, the wear state of the mud motor (if used), and the formation (13 in FIG. 1) being drilled. The relationships are dynamic, that is, they are continuously updated by input of real time data and thus may adapt to changing conditions in the wellbore. The relationships thus determine may be used to directly control the drilling operation by sending set points of RPM and rate of penetration (ROP) from the optimizer (194 in FIG. 4) to the controller (186 in FIG. 4).

Figure 12:
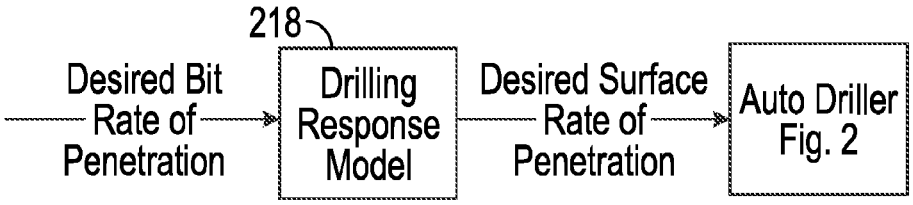

When the drilling plan (i.e., a set of specifications for drilling and ancillary operations to construct the wellbore) indicates one or more sections of the wellbore are to undergo controlled drilling, the desired bit rate of penetration may be be converted to a surface rate of penetration value by a drill string response model as shown in FIG. 12 at 218. The calculated value of bit rate of penetration may then be sent to the controller (186 in FIG. 4) which operates the automatic driller (e.g., as in FIG. 2) to release the drill string at the surface ROP which will result in the desired ROP at the drill bit. The foregoing is shown in FIG. 12.

Figure 13:
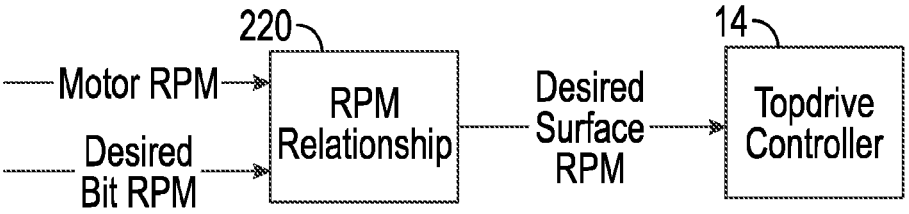

To control the bit RPM, the desired value of bit RPM may be transmitted to the optimizer (194 in FIG. 4) which may use a determined RPM relationship at 220 in FIG. 13 along with an estimate of the mud motor RPM (if a mud motor is used). The RPM relationship computes a surface RPM that will result in the desired bit RPM and communicates a control signal to the top drive (14 in FIG. 1) or rotary table (not shown in the Figures) speed controller at 14 in FIG. 13 which then operates the top drive or rotary table at the computed surface RPM to obtain the desired bit RPM. The foregoing is shown in FIG. 13.

Figure 14:
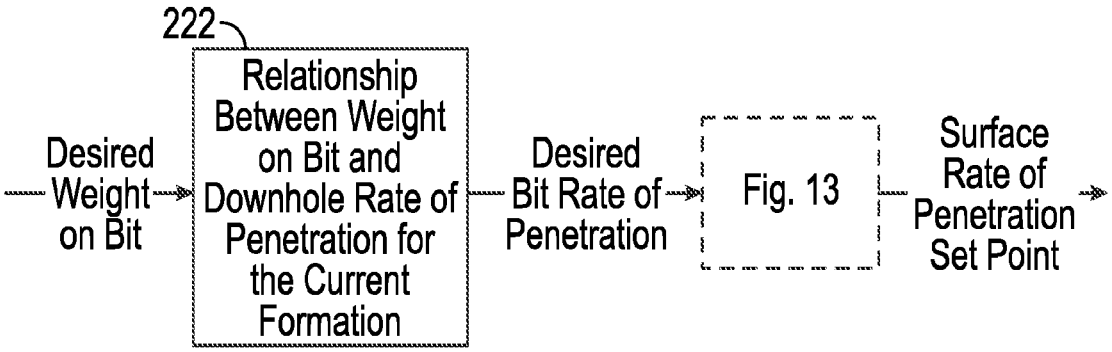

For the case where the weight on bit is a limiting factor, a desired weight on bit may be used to calculate a desired bit rate of penetration using the determined relationship for the current formation as shown at 222 in FIG. 14. After calculation of the desired weight on bit, the process shown in FIG. 10 may be used to determine set points for surface rate of penetration per FIG. 13 (e.g., rate of release of the drill string by lowering the top drive 14 in FIG. 1).

When the maximum torque applied to the drill string is limited, one may use the bit drilling response model to convert the desired torque into a selected surface measured weight on bit. Using the relationship shown in FIG. 12, a desired weight may be converted to a surface rate of penetration set point. The foregoing setpoint may be communicated from the optimizer (194 in FIG. 4) to the controller (186 in FIG. 4) to operate the rig automatically to maintain the set point surface ROP.

Figure 15:
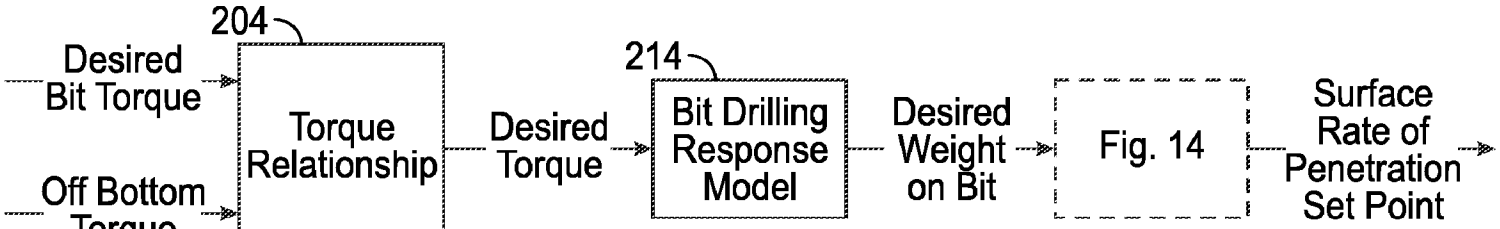
Figure 16:
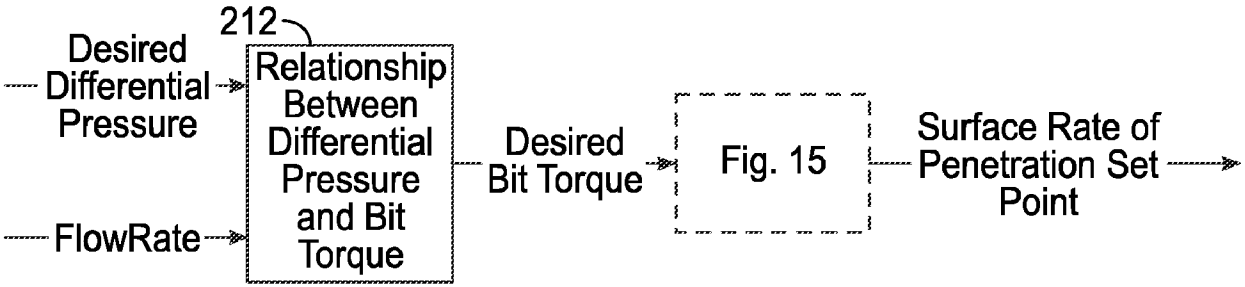

When the limiting parameter is differential pressure (i.e., the increase in standpipe pressure above the off bottom pressure measured as explained with reference to FIG. 5), the determined relationship between differential pressure and bit torque at 204 in FIG. 15 may be used with the bit drilling response model 214 to determine a desired bit torque as previously explained. Using desired bit torque, at 212 in FIG. 16, the process shown in FIG. 15 may then be used to compute the set point for surface rate of penetration as explained with reference to FIG. 14. As previously explained, the foregoing setpoint may be communicated from the optimizer (194 in FIG. 4) to the controller (186 in FIG. 4) to operate the rig automatically to maintain the set point surface ROP.

Figure 17:
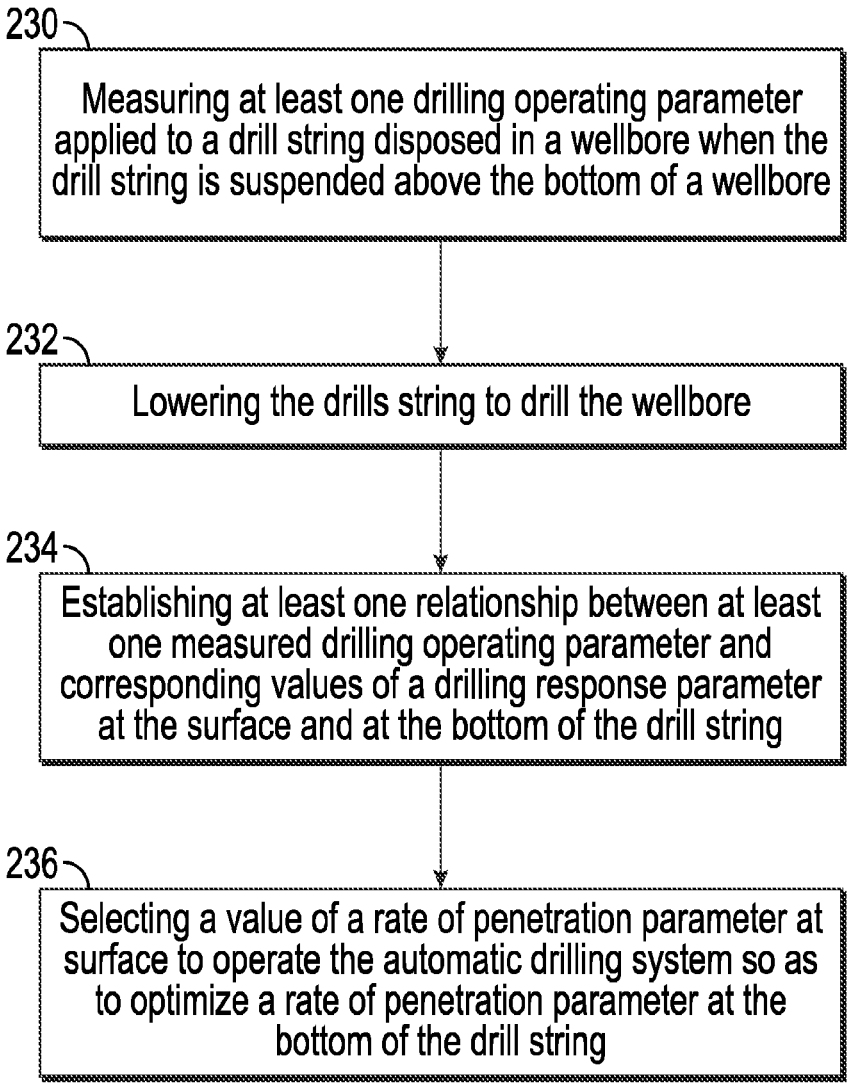
FIG. 17 shows a flow chart of one example embodiment of a method according to the disclosure.

A flow chart of an example embodiment according to the present disclosure is shown in FIG. 17. At 230 at least one drilling operating parameter applied to a drill string disposed in a wellbore is measured when the drill string is suspended above the bottom of a wellbore. At 232 the drill string is lowered to drill the wellbore. At 234, at least one relationship between at least one measured drilling operating parameter and corresponding values of a drilling response parameter at the surface and at the bottom of the drill string is established. At 236 a value of a rate of penetration parameter is selected at surface to operate the automatic drilling system so as to optimize a rate of penetration parameter at the bottom of the drill string.

Real time relationships based on drilling models according to the present disclosure may be used to control an auto driller at specific set points of rate of penetration. Using such method may provide one or more of the following advantages.

The relationships determined using drilling models may be more representative of the actual drilling process than generic PID models that may be contained in the automatic driller controller (168 in FIG. 2). The determined relationships may be used to smoothly change the drilling parameters and also to estimate the values at any proposed point along a planned wellbore trajectory. A method according to the present disclosure may result in control of the drilling in a smoother fashion while maintaining all parameters within a safe operating range.

The drilling models and relationships may adjust in real time in different subsurface formations and drilling conditions, thereby maintaining smooth and safe drilling without the need for manual control of parameters for the auto driller.

Figure 18:
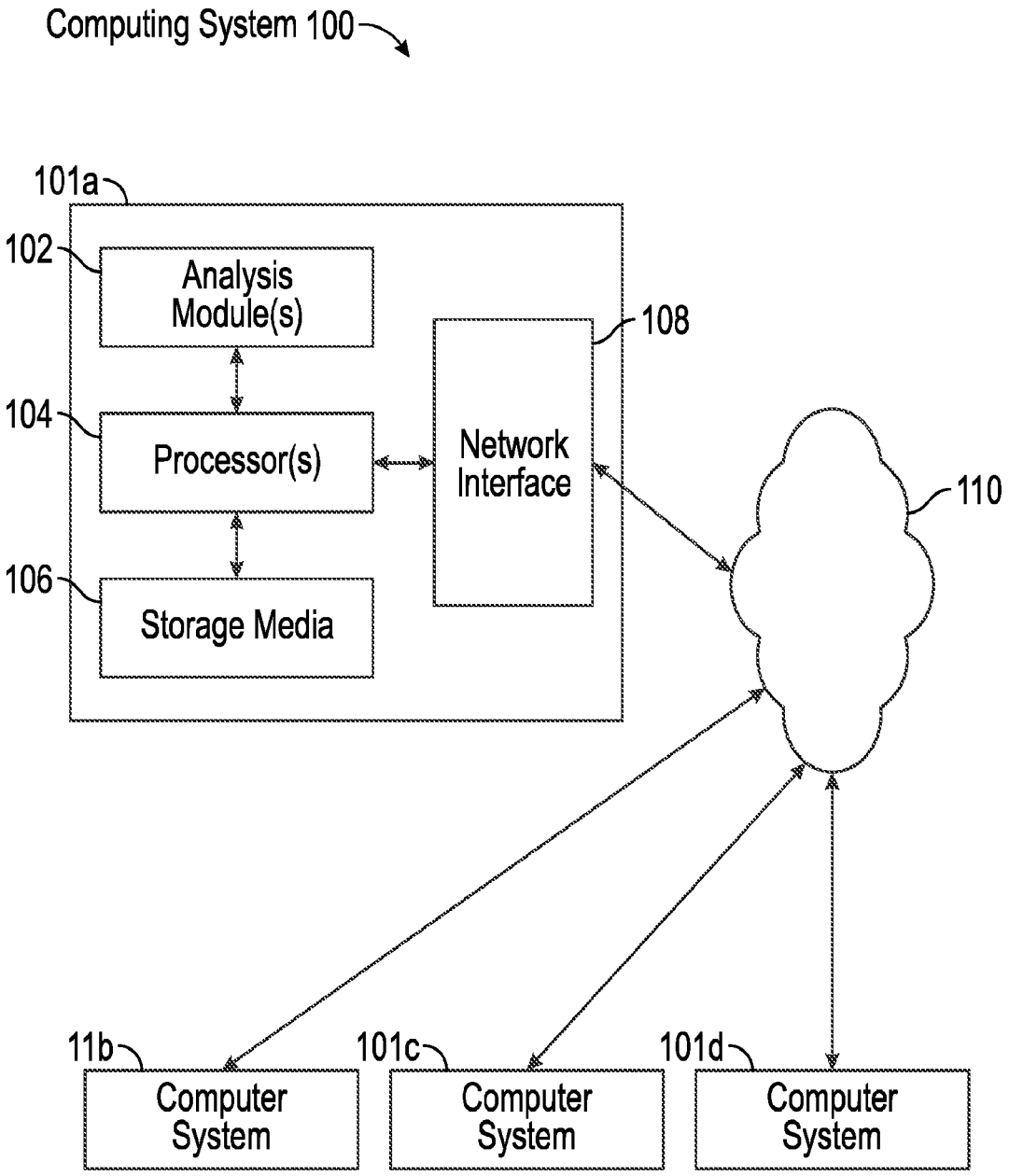
FIG. 18 shows an example computer system that may be used in some embodiments.

FIG. 18 shows an example computing system 100 in accordance with some embodiments. The computing system 100 may be an individual computer system 101A or an arrangement of distributed computer systems. The individual computer system 101A may include one or more analysis modules 102 that may be configured to perform various tasks according to some embodiments, such as the tasks explained with reference to FIGS. 2-17. To perform these various tasks, the analysis module 102 may operate independently or in coordination with one or more processors 104, which may be connected to one or more storage media 106. A display device 105 such as a graphic user interface of any known type may be in signal communication with the processor 104 to enable user entry of commands and/or data and to display results of execution of a set of instructions according to the present disclosure.

The processor(s) 104 may also be connected to a network interface 108 to allow the individual computer system 101A to communicate over a data network 110 with one or more additional individual computer systems and/or computing systems, such as 101B, 101C, and/or 101D (note that computer systems 101B, 101C and/or 101D may or may not share the same architecture as computer system 101A, and may be located in different physical locations, for example, computer systems 101A and 101B may be at a well drilling location, while in communication with one or more computer systems such as 101C and/or 101D that may be located in one or more data centers on shore, aboard ships, and/or located in varying countries on different continents).

A processor may include, without limitation, a microprocessor, microcontroller, processor module or subsystem, programmable integrated circuit, programmable gate array, or another control or computing device.

The storage media 106 may be implemented as one or more computer-readable or machine-readable storage media. Note that while in the example embodiment of FIG. 18 the storage media 106 are shown as being disposed within the individual computer system 101A, in some embodiments, the storage media 106 may be distributed within and/or across multiple internal and/or external enclosures of the individual computing system 101A and/or additional computing systems, e.g., 101B, 101C, 101D. Storage media 106 may include, without limitation, one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that computer instructions to cause any individual computer system or a computing system to perform the tasks described above may be provided on one computer-readable or machine-readable storage medium, or may be provided on multiple computer-readable or machine-readable storage media distributed in a multiple component computing system having one or more nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that any other embodiment of a computing system may have more or fewer components than shown, may combine additional components not shown in the example embodiment of FIG. 18, and/or the computing system 100 may have a different configuration or arrangement of the components shown in FIG. 18. The various components shown in FIG. 18 may be implemented in hardware, software, or a combination of both hardware and software, including one or more signal processing and/or application specific integrated circuits.

Further, the acts of the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

A method of controlling an autodriller according to the present disclosure based on representative drilling relationships may enable finer control of the drilling process by maintaining drilling parameters within smaller ranges.

The smoother drilling system proposed with a finer control may improve the rate of penetration, enable better trajectory control and, as a result, achieve superior wellbore quality.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f), for any limitations of any of the claims herein, except for those in which the claim expressly uses the words "means for" together with an associated function.

What is claimed is:

1. A method for controlling an automatic drilling system, comprising:

measuring at least one drilling operating parameter applied to a drill string disposed in a wellbore when the drill string is suspended above the bottom of a wellbore;

lowering the drill string to drill the wellbore;

establishing at least one relationship between at least one measured drilling operating parameter and corresponding values of a drilling response parameter at the surface and at the bottom of the drill string; and selecting a value of a rate of penetration parameter at the surface to operate the automatic drilling system so as to optimize a rate of penetration parameter at the bottom of the drill string.

2. The method of claim 1 wherein the at least one relationship comprises surface measured rate of penetration with respect to weight applied to a drill bit.

3. The method of claim 1 wherein the at least one relationship comprises surface measured rate of penetration with respect to torque applied to a drill bit.

4. The method of claim 1 wherein the at least one relationship comprises surface measured rate of penetration with respect to torque applied at the surface.

5. The method of claim 1 wherein the at least one relationship comprises surface measured rate of penetration with respect to downhole differential fluid pressure.

6. The method of claim 1 wherein the at least one relationship comprises surface measured rate of penetration with respect to rotary speed of a drilling motor.

7. The method of claim 1 wherein the at least one relationship comprises weight on a drill bit and rate of penetration measured at surface with respect to rate of penetration and drill bit rotation speed at the bottom of the drill string.

8. The method of claim 1 wherein the at least one relationship comprises an increase in drilling mud pressure with respect to weight applied to a drill bit.

9. The method of claim 1 wherein the at least one relationship comprises torque applied to a drill string at the surface with a rate of penetration of the drill string.

10. The method of claim 1 wherein the operating the automatic drilling system comprises controlling a draw works drum and associated drill line.

11. The method of claim 1, wherein selecting the surface rate of penetration comprises:

determining a limiting drilling parameter; and determining the rate of penetration at the surface based on the limiting drilling parameter and the at least one relationship.

12. The method of claim 11, wherein the limiting drilling parameter comprises flow rate, and wherein determining the rate of penetration at the surface based on the limiting drilling parameter comprises:

determining a bit torque based on the flow rate using a relationship between differential pressure and the bit torque;

determining a torque value based on the bit torque and an off-bottom torque using a torque relationship;

determining a weight on bit value based on the torque value using a bit drilling response model;

determining a bit rate of penetration based on the weight on bit value using a relationship between weight on bit and downhole rate of penetration for a current formation; and determining the rate of penetration at the surface based on the bit rate of penetration using a drilling response model.

13. An automatic drilling system, comprising:

at least one sensor for measuring a drilling operating parameter in signal communication with a processor;

the processor programmed to determine at least one relationship between the measured drilling parameter when a drill string is suspended above the bottom of a wellbore;

the processor programmed to determine at least one relationship between the at least one measured drilling operating parameter and corresponding values of a drilling response parameter at the surface and at the bottom of the drill string; and a drill string release control in signal communication with the processor, the processor programmed to select, based on the at least one relationship between the at least one measured drilling operation parameter and the corresponding values of the drilling response parameter at the surface and at the bottom of the drill string, a value of a rate of penetration parameter at the surface that optimizes a rate of penetration parameter at the bottom of the drill string, and to cause the drill string release control to release the drill string at a rate configured to result in the selected value of the rate of penetration parameter at the surface.

14. The automatic drilling system of claim 13 wherein the drill string release control comprises a servo motor operatively coupled to a drawworks brake control.

15. The automatic drilling system of claim 13 wherein the at least one sensor comprises a drilling fluid pressure sensor.

16. The automatic drilling system of claim 13 wherein the at least one sensor comprises a torque sensor for measuring torque applied to the drill string at the surface.

17. The automatic drilling system of claim 13 wherein the at least one sensor comprises a rotary speed sensor for measuring rotating speed of the drill string at the surface.

18. The automatic drilling system of claim 13 wherein the at least one sensor comprises a hookload sensor.

19. The automatic drilling system of claim 13 further comprising an optimizer in signal communication with the processor, the optimizer programmed to accept as input signals from a plurality of drilling operating parameter sensors, the optimizer programmed to determine relationships between signals measured by the plurality of drilling operating parameter sensors and rate of penetration of the drill string at the bottom end thereof, the optimizer programmed to cause the processor to operate the drill string release control to maintain a rate of penetration of the drill string optimized based on the determined relationships.

20. The automatic drilling system of claim 13 wherein the at least one sensor comprises a winch drum rotary position encoder.

21. The automatic drilling system of claim 13 wherein the drill string comprises a measurement while drilling instrument system.

22. One or more non-transitory computer-readable storage media comprising processor-executable instructions to instruct a computing system to:

measure at least one drilling operating parameter applied to a drill string disposed in a wellbore when the drill string is suspended above the bottom of a wellbore;

establish at least one relationship between at least one measured drilling operating parameter and corresponding values of a drilling response parameter at the surface and at the bottom of the drill string after the drill string is lowered into the wellbore; and select a value of a rate of penetration parameter at the surface to operate the automatic drilling system so as to optimize a rate of penetration parameter at the bottom of the drill string.

* * * * *